US011052683B2

(12) United States Patent
Fromm et al.

(10) Patent No.: US 11,052,683 B2
(45) Date of Patent: Jul. 6, 2021

(54) SINGLE NIP DEVICE FOR DE-SKEWING SUBSTRATES AND LATERALLY REGISTERING THE SUBSTRATES WITH A PRINT ZONE IN A PRINTER

(71) Applicant: Xerox Corporation, Norwalk, CT (US)

(72) Inventors: Paul M. Fromm, Rochester, NY (US); Erwin Ruiz, Rochester, NY (US); Frank B. TamarezGomez, Webster, NY (US); Rachel Bierasinski, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 58 days.

(21) Appl. No.: 16/700,596

(22) Filed: Dec. 2, 2019

(65) Prior Publication Data

US 2020/0108635 A1 Apr. 9, 2020

Related U.S. Application Data

(62) Division of application No. 16/102,777, filed on Aug. 14, 2018, now Pat. No. 10,525,744.

(51) Int. Cl.

| | |
|---|---|
| ***B41J 13/00*** | (2006.01) |
| ***B41J 13/26*** | (2006.01) |
| ***B41J 11/00*** | (2006.01) |

(52) U.S. Cl.

CPC ..... *B41J 13/0009* (2013.01); *B41J 11/0055* (2013.01); *B41J 13/26* (2013.01)

(58) Field of Classification Search

CPC .. B41J 13/0018; B41J 11/0055; B41J 29/393; B41J 13/0009; B41J 13/26; B41J 29/38; B41J 15/046; B65H 2301/331; B65H 9/00; B65H 9/002

See application file for complete search history.

(56) References Cited

U.S. PATENT DOCUMENTS

| | | | | |
|---|---|---|---|---|
| 6,137,517 | A | 10/2000 | Furst et al. | |
| 6,634,521 | B1 * | 10/2003 | Hwang | B65H 9/002 221/228 |
| 6,736,394 | B2 | 5/2004 | Herrmann et al. | |
| 6,862,375 | B1 | 3/2005 | Keithley et al. | |
| 7,748,697 | B2 | 7/2010 | Fujita et al. | |
| 2008/0296835 | A1 | 12/2008 | Dejong et al. | |
| 2010/0327518 | A1 * | 12/2010 | Tharayil | B65H 9/002 271/227 |
| 2011/0156345 | A1 | 6/2011 | deJong et al. | |
| 2012/0013066 | A1 * | 1/2012 | deJong | B65H 9/002 271/227 |

* cited by examiner

*Primary Examiner* — Jannelle M Lebron

(74) *Attorney, Agent, or Firm* — Maginot Moore & Beck LLP

(57) ABSTRACT

A single nip de-skew, lateral registration, and process direction registration device removes skew, laterally registers, and registers in the process direction substrates moving along a media transport path. The single nip de-skew, lateral registration, and process direction registration device includes a fixed roller that is longer than a rotating wheel that forms a nip with the fixed roller. The wheel has a coefficient of friction that is higher than a coefficient of friction of the roller so an actuator translating the wheel along the fixed roller laterally registers and de-skews substrates.

20 Claims, 5 Drawing Sheets

SINGLE NIP DEVICE FOR DE-SKEWING SUBSTRATES AND LATERALLY REGISTERING THE SUBSTRATES WITH A PRINT ZONE IN A PRINTER

PRIORITY CLAIM

This application is a divisional of and claims priority to presently pending U.S. patent application Ser. No. 16/102,777, which is entitled "System And Method For De-Skewing Substrates And Laterally Registering The Substrates With A Print Zone In A Printer," which was filed on Aug. 14, 2018, and which issued as U.S. Pat. No. 10,525,744 on Jan. 7. 2020.

TECHNICAL FIELD

This disclosure relates generally to devices for handling substrates in printers prior to printing the substrates, and more particularly, to de-skewing the substrates and laterally registering the substrates with a print zone in such printers.

BACKGROUND

Accurate and reliable registration of substrate media as the media travel in a process direction through the printer are important for the production of quality images. Even a slight skew or misalignment of the substrate media as the substrate passes the printheads for image formation can lead to image and color registration errors. Known nip assemblies used to correct skew and adjust for lateral registration of the substrates position multiple nips along a cross-process direction of a media transport path to de-skew and laterally translate the substrates. As substrate processing speeds increase, the force applied by the rollers in these nip assemblies intensifies so the skew and lateral registration can be corrected within the decreasing time provided for such correction. The force applied by the rollers may wrinkle, tear, or buckle medium and light-weight substrate media. Accordingly, a printer that can register images on substrates and de-skew substrate media before printing in these high-speed printing systems without applying forces that can wrinkle, tear, or buckle the substrate media would be beneficial.

SUMMARY

A new printer includes at least a pair of centrally positioned substrate de-skew and lateral registration devices to increase the speed of substrate alignment for printing beyond that achieved with printers that use multiple de-skew devices along a cross-process direction of the media transport path. The printer includes an image generator positioned opposite a media transport path, the image generator being configured to form ink images on substrates being carried along the media transport path in a process direction, a first single nip de-skew, lateral registration, and process direction registration device positioned at a location on the media transport path before the substrates are opposite the image generator and centrally positioned in a cross-process direction of the media transport path, and a second single nip de-skew, lateral registration, and process direction registration device positioned at a location on the media transport path before the substrates are opposite the image generator and before the substrates are opposite the first single nip de-skew, lateral registration, and process direction registration device and centrally positioned in the cross-process direction of the media transport path so the first and the second single nip de-skew, lateral registration, and process direction registration devices are aligned in the process direction.

A single nip de-skew, lateral registration, and process direction registration device for a printer is configured with a single nip that can be centrally positioned in the media transport path of a printer to increase the speed of aligning substrates with the print zone in the printer. The de-skew and laterally registration device includes a first roller fixedly mounted and configured to be positioned on one side of a media transport path to engage a surface of substrates, and a nip assembly that is configured to be positioned on an opposite side of the media transport path to engage a surface of the substrates, the nip assembly being configured for movement to enable the nip assembly to form a nip with the first roller selectively.

BRIEF DESCRIPTION OF THE DRAWINGS

The foregoing aspects and other features of a printer that includes at least a pair of centrally positioned substrate de-skew and registration devices to increase the speed of substrate alignment for printing beyond that achieved with printers that use mechanical devices positioned to apply forces along a cross-process direction of the media transport path are explained in the following description, taken in connection with the accompanying drawings.

DETAILED DESCRIPTION

Figure 1:
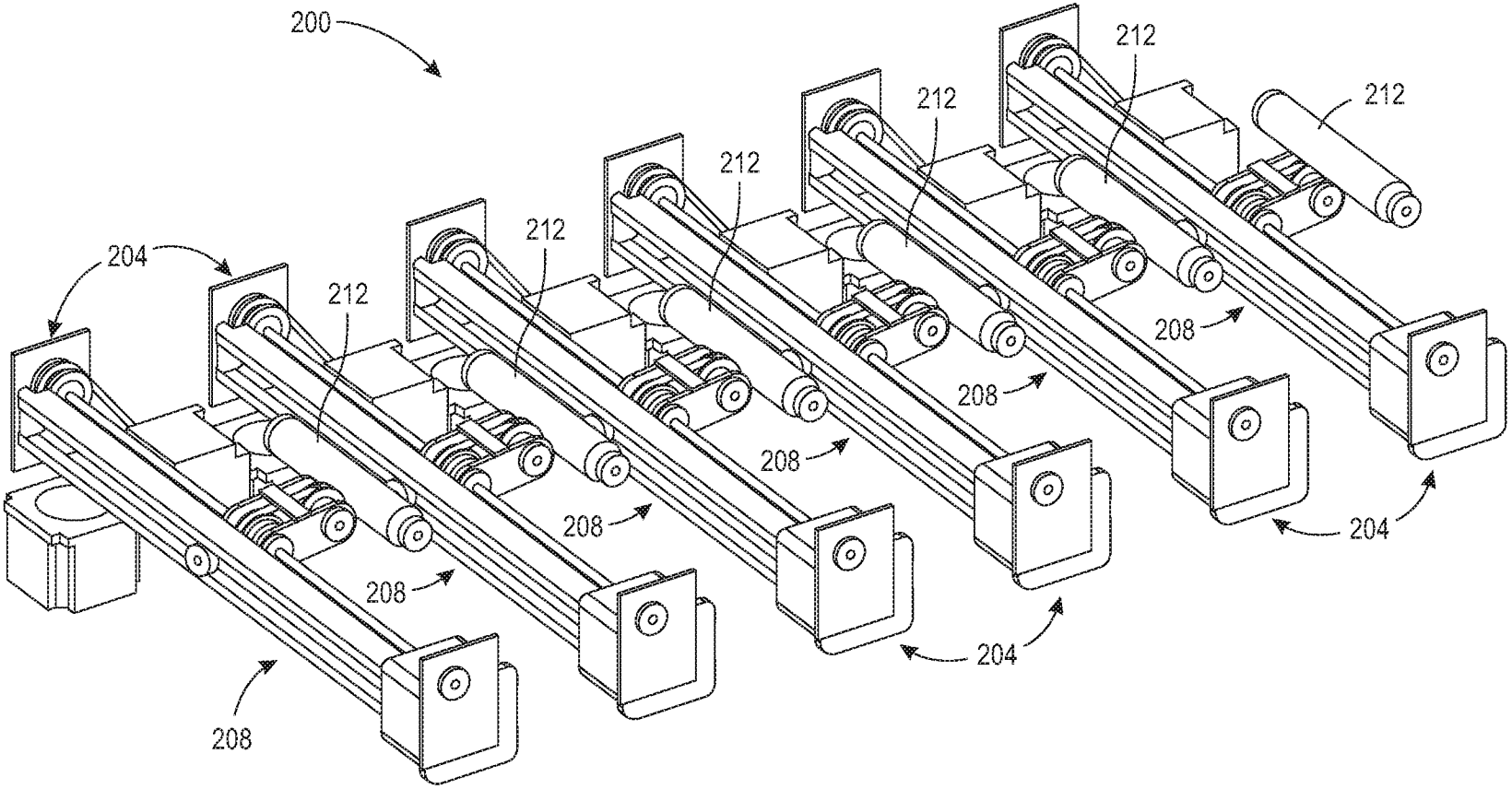
FIG. 1 is a perspective view of a plurality of de-skew and lateral registration devices in a printer that correct skew and lateral registration of substrates for different sizes of substrates.

For a general understanding of the present embodiments, reference is made to the drawings. In the drawings, like reference numerals have been used throughout to designate like elements.

Figure 5:
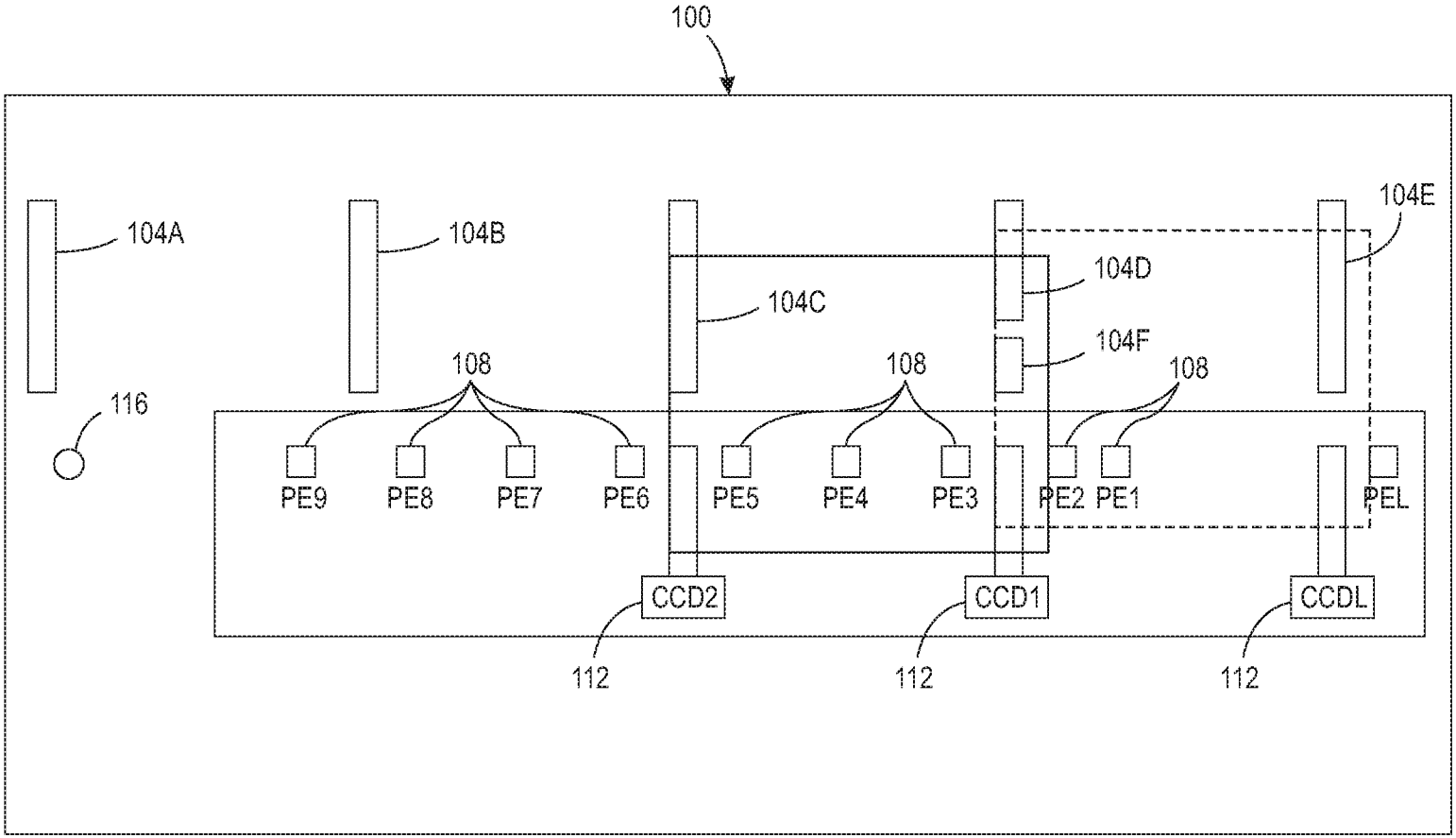
FIG. 5 PRIOR ART
FIG. 5 depicts a prior art printer that de-skews and laterally registers substrates using multiple nips along the cross-process direction of the media transport path before printing the substrates.

FIG. 5 depicts a known substrate registration system 100 in a printer that is configured to de-skew substrate media and register the substrates for image printing. The system 100 includes five nips 104A, 104B, 104C, 104D, and 104E, photoelectric sensors 108, charge coupled device (CCD) sensors 112, and a registration entrance sensor 116. The nips 104A-104E are formed by roller pairs. The registration entrance sensor 116 detects the leading edge of a substrate to initiate the operation of the system 100. The photoelectric sensors 108 are used to monitor the progress of the leading edge and trailing edge in the system to trigger the CCDs, operate rollers in the nips, and other timing functions. The CCD sensors 112 identify the amount of skew and lateral offset of the substrates by detecting the positions of the substrates traveling closest to the CCD sensors 112 through the system 100. The identified skew and lateral offset are used to vary the speeds of the rollers in the nips 104D and 104F to rotate and translate the substrates because the actuators driving the rollers in nip 104D and 104F are independently controlled to slow down one side of a substrate so the skewed portion of the substrate can catch up to the slowed side and remove the skew or translate the substrate. For example, as shown in FIG. 5, the CCD sensors 112 identify the positions of the edge of the substrate closest to the CCD2 and CCD1 sensors and the controller that receives the signals from these sensors determines the substrate is not skewed since both sensors are equidistant from the edge opposite the sensors. These signals, however, are used by the controller to determine that the substrate is not centered with the print zone of the printer. To move the substrate to the center of the print zone, which follows the section of the media transport path shown in the figure, the controller operates the actuators rotating the rollers in nip 104F to accelerate the substrate and to decelerate the rollers in nip 104D. This action introduces skew that points the substrate towards the center. Subsequently, the controller operates the actuators in these two nips to decelerate the rollers in nip 104F and accelerate the rollers in nip 104D to de-skew the substrate at a position that centers the substrate with the print zone. The nips 104D, 104E and 104F then direct the laterally registered substrate, shown in dashed lines in the figure, towards the print zone. The rightmost photoelectric sensor 108 in FIG. 5 detects the leading edge of the de-skewed and laterally registered substrate for timing of the image transfer or image printing onto the substrate. The system 100 limits the processing speed of the substrates in the printer because the nips 104D and 104F apply significant forces to the substrates in the cross-process direction to perform the simultaneous correction of skew and lateral offset. These forces can be capable of wrinkling, buckling, or tearing the lighter weight substrates. Likewise, as the size and mass of the substrate increases, the forces required to move the sheet are difficult to generate without damaging the substrate.

To address the issues arising from the system 100, a plurality of de-skew, lateral registration, and process registration devices have been centrally positioned and aligned with the center line of the media transport path to coordinate the de-skewing, lateral registration, and process direction registration of substrates without subjecting the substrates to the forces generated by multiple de-skew nips in the cross-process direction of a media transport path. The new system 200 is shown in FIG. 1. System 200 as illustrated includes six single nip de-skew, lateral registration, and process direction registration devices 204, also called de-skew and registration devices in this document, that are positioned in a media sheet transport path. Each single nip de-skew, lateral registration, and process direction registration device 204 has a lower nip assembly 208 and an upper nip roller 212. The lower nip assembly 208 is described in more detail below with reference to FIG. 2A and FIG. 2B. The upper nip roller 212 is fixedly mounted to structure above the media sheet transport path that has not been shown to simply the figure. The upper nip roller 212 is significantly longer than the nip roller of the lower nip assembly 208 to enable a wheel of the lower nip assembly to move along the length of the fixed roller 212 bidirectionally. The length of the upper nip roller 212 is long enough to at least span the center lines of the full range of media widths the device is able to feed along the media transport path. The upper nip roller 212 is not driven but follows the rotation of the driven wheel in the lower nip assembly. A baffle or media support plate (not shown to simplify the figure) is interposed between the lower nip assemblies 208 and the upper nip roller 212. These baffles or support plates support the substrates moving along the media transport path and have openings in them to expose the wheel of the lower nip assembly 208 to enable a nip to be formed between the wheel of the lower nip assembly 208 and the upper nip roller 212. The single nip de-skew and registration devices 204 are spaced at intervals that enable one device 204 to manipulate a leading edge of a media sheet and another device 204 to manipulate the trailing edge of the same sheet in the process direction. By including a plurality of devices 204, different devices 204 can be selectively operated to accommodate a wide variety of sheet lengths. As used in this document, the term "process direction" refers to the direction of motion of the substrate as it passes through the series of single nip de-skew and registration devices and the term "cross-process direction" refers to an axis that is perpendicular to the process direction in the plane of the substrate.

A controller, described in more detail below, is configured with programmed instructions stored in a memory operatively connected to the controller and the execution of these instructions by the controller enables the controller to receive signals generated by photoelectric sensors and CCD devices as described above with regard to FIG. 5 and determine the amount of skew in a substrate approaching the single nip de-skew and registration devices 204. The execution of these instructions further enables the controller to generate signals for the actuators described in more detail below that open and close the nips, enable sheet rotation about the nips to remove the skew, and translate the wheel of the lower nip assembly in a device 204 to register the substrate with a print zone opposite an image generator used to form ink images on the substrates. As used in this document, the term "de-skew" refers to the orienting of a substrate so the leading edge and the trailing edge of the substrate is perpendicular to the process direction. As used in this document, the term "lateral register" means to align a sheet edge with a print zone reference point or line so the sheet correctly enters the print zone opposite a plurality of printheads for printing.

Besides de-skewing the substrate, the controller uses CCD sensor data to identify the lateral position of the substrate and the process direction path of the substrate into and through the print zone. As used in this document, "print zone" means an area aligned with the process direction of substrate movement and is centered opposite an image generator so an ink image can either be transferred to or printed directly on the substrate by the image generator. In some printers, the image generator is an array of printheads, each of which has a plurality of inkjets that form an ink image on an intermediate rotating member and the intermediate rotating member forms a nip with a rotating transfer member underlying the intermediate member and the path of the substrate through the print zone so the image formed on the intermediate member is transferred to the substrate as the substrate passes through the nip. In other printers, the image generator includes an array of printheads, each of which has a plurality of inkjets. The printheads are positioned opposite the print zone and oriented to enable the inkjets to eject drops of ink directly onto the substrate to form an ink image on the substrate as the substrate passes through the print zone. The de-skewing and lateral registration system can also be used with other printing systems, such as xerography printing system that use toner or offset printing systems that use engraved rollers to apply ink to media. The de-skewing and lateral registration system also performs process direction registration of the media sheets. As used in this document, "process direction registration" means the leading edge of the media is presented to the print zone opposite the image generator at the correct time for aligning the image to be transferred or printed with the leading edge of the media.

Figure 2A:
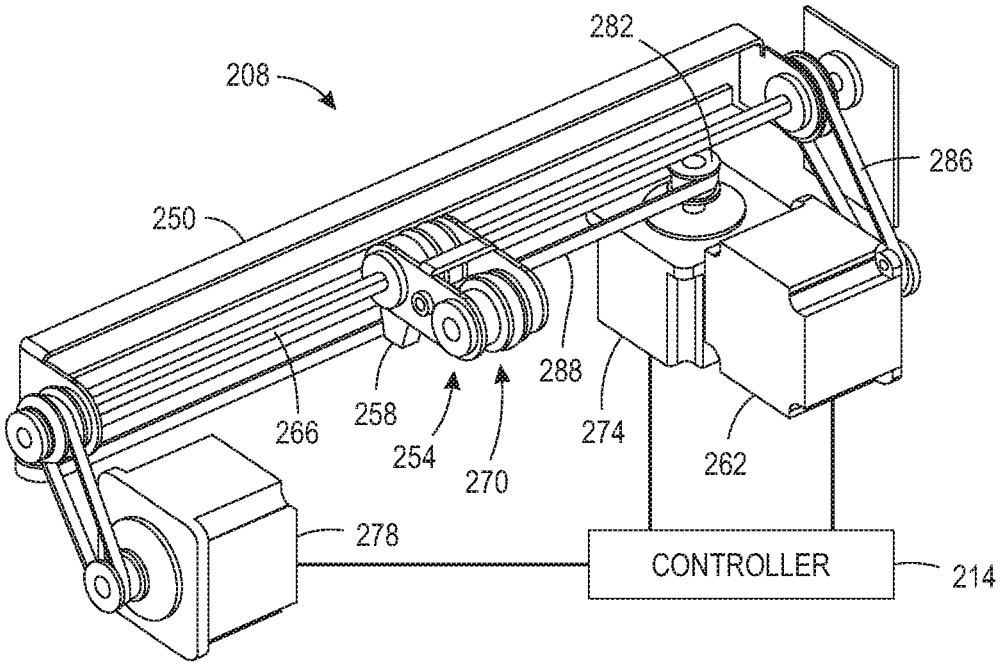
FIG. 2A is a perspective view of a lower nip assembly used in the devices shown in FIG. 1.
Figure 2B:
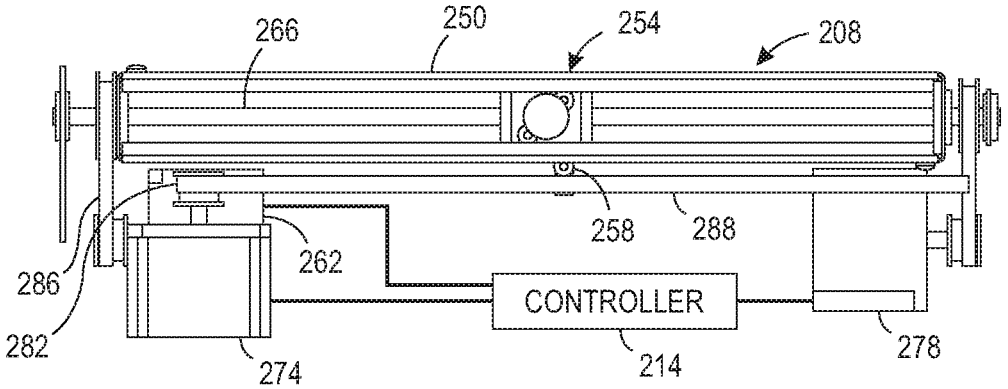
FIG. 2B is a frontal view of the lower nip assembly shown in FIG. 2A.

One of the lower nip roller assemblies 208 of one of the single nip de-skew and lateral registration devices 204 is shown in FIG. 2A and FIG. 2B. The lower nip roller assembly 208 includes a controller 214, an actuator bar 250, a nip wheel driver 254, and a translator link 258. The controller 214 operates the actuator 262 to rotate the endless belt 286 and actuator bar 250 about rotating member 266 to move one end of the nip wheel driver 254. When the actuator bar 250 moves the one end of the nip wheel driver 254 in a first direction, the wheel 270 rises up to engage fixed roller 212 (FIG. 1) to form a nip for manipulating movement of a sheet. When the controller 214 operates the actuator 262 to reverse the rotation of the endless belt 286 and the actuator bar 250, the actuator bar 250 moves the one end of the nip wheel driver 254 to drop the wheel 270 away from the fixed roller 212 so the nip between the two rollers is no longer present. The controller 214 also operates the actuator 278 to control the rate of rotation of the rotating member 266, which is coupled to the wheel 270 by a pulley as described below with reference to FIG. 3A and FIG. 3B. The controller 214 regulates the rotation of the rotating member 266 to change the rotation of the wheel 270 to effect process direction registration of the substrate within the nip formed by wheel 270 and the fixed roller 212. The controller 214 operates the actuator 274 to rotate the pulley 282 and the endless belt 288 to move the nip wheel driver 254 in the cross-process direction bidirectionally to laterally register and de-skew the substrate held in the nip between the wheel 270 and the upper fixed roller 212. De-skewing occurs when one of the lower nip roller assemblies 208 is moved relative to another lower nip roller assembly 208 while lateral registration occurs when a pair of lower nip roller assemblies 208 are moved together in the same direction and speed.

Figure 3A:
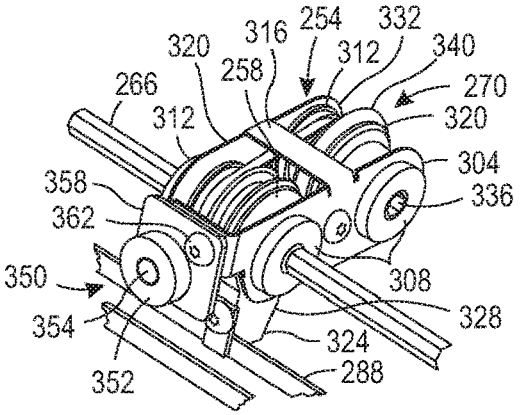
FIG. 3A is a perspective view of a nip wheel driver of the assembly shown in FIG. 2A and FIG. 2B.
Figure 3B:
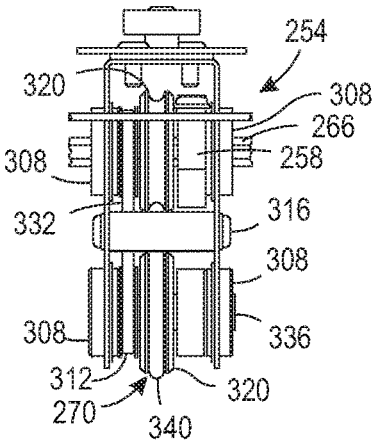
FIG. 3B is a top view of the nip wheel driver shown in FIG. 3A.
Figure 3C:
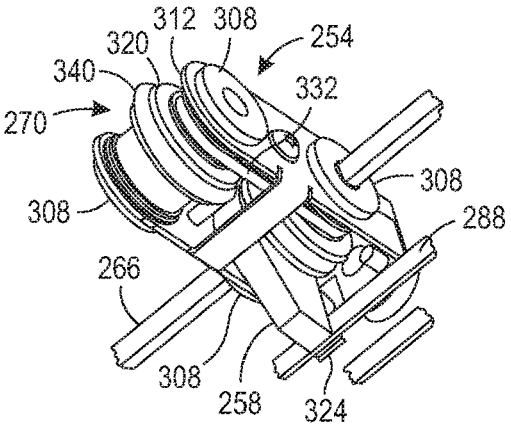
FIG. 3C is a bottom view of the nip wheel driver shown in FIG. 3A.

FIG. 3A, FIG. 3B, and FIG. 3C depicts the nip wheel driver 254 in more detail. A U-shaped bracket 304 has four bearings 308 mounted in the flanges of the bracket. A cross-member 316 helps stabilize the flanges of the bracket 304. The rotating member 266 is rotatably supported by two bearings 308 in flanges on the opposite sides of the bracket 304. Also mounted on the rotating member 266 between the two bearings 308 is a pulley 312, a rotating wheel 320, and the translator link 258. A gripping tab 324 is attached to the translator link 258 by a screw 328 or other type of attaching member to secure the translator link 258 to the endless belt 288 to enable the bracket 304 of the nip wheel driver 254 to follow the endless belt 288 when it is moved by the controller 214 operating the actuator 274 to rotate the pulley 282. Another endless belt 332 engages both pulleys 312 to enable the rotation of the rotating member 266 to rotate the pulleys 312. A shaft 336 extends through the other set of bearings 308 and the other pulley 312 between the two flanges of the bracket 304. Wheel 270 includes another rotating wheel 320, which is rigidly mounted about the shaft 336 to connect it to the pulley 312, and an O-ring 340 or other narrow high coefficient of friction member fitted within a groove in rotating wheel 320. The coefficient of friction of the tire or O-ring 340 is significantly larger than the coefficient of friction of the fixed roller 212 so when the nip wheel driver 254 is translated, the media follow the wheel 270 and slide on the fixed roller 212. An actuator bar coupler 350 has a plate 358 that is mounted to the bracket 304 by a pair of screws 362 or a similar attaching member. An actuator bar bearing 352 is mounted about a shaft 354 that extends from the plate 358. The actuator bar 250 surrounds the upper and the lower edge of the actuator bar bearing 352 as shown in FIG. 2A, FIG. 2B, FIG. 4A, and FIG. 4B to enable rotation of the endless belt 286 to move the lower nip assembly 208 to form a nip between the O-ring 340 and the fixed roller 212 selectively. Endless belt 288 can move nip wheel driver 254 laterally while actuator bar bearing 352 rolls on one side of the slot in actuator bar 250.

Figure 4A:
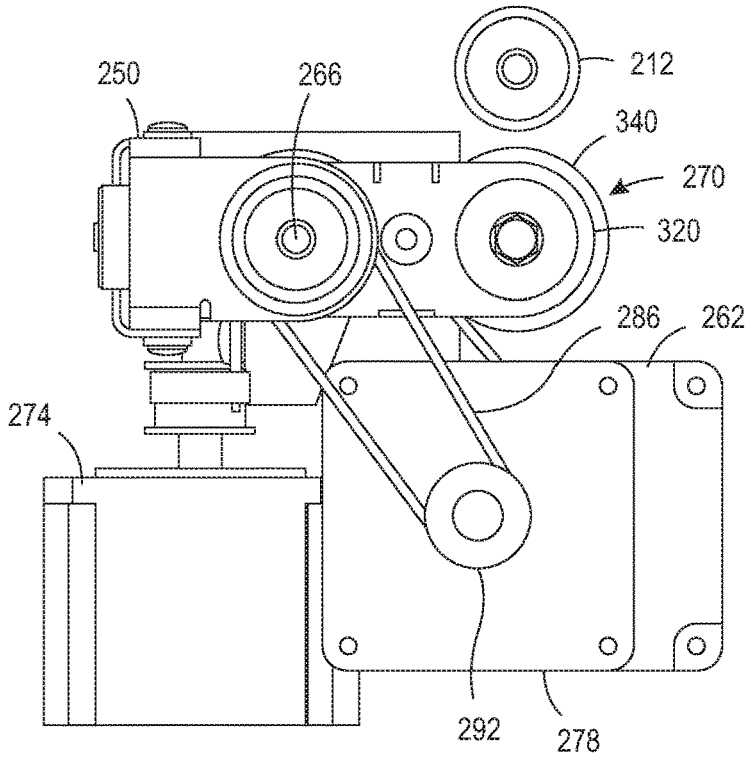
FIG. 4A is a side view of a lower nip assembly of FIG. 2A in which the wheel of the nip wheel driver is disengaged from the fixed roller to prevent nip formation.
Figure 4B:
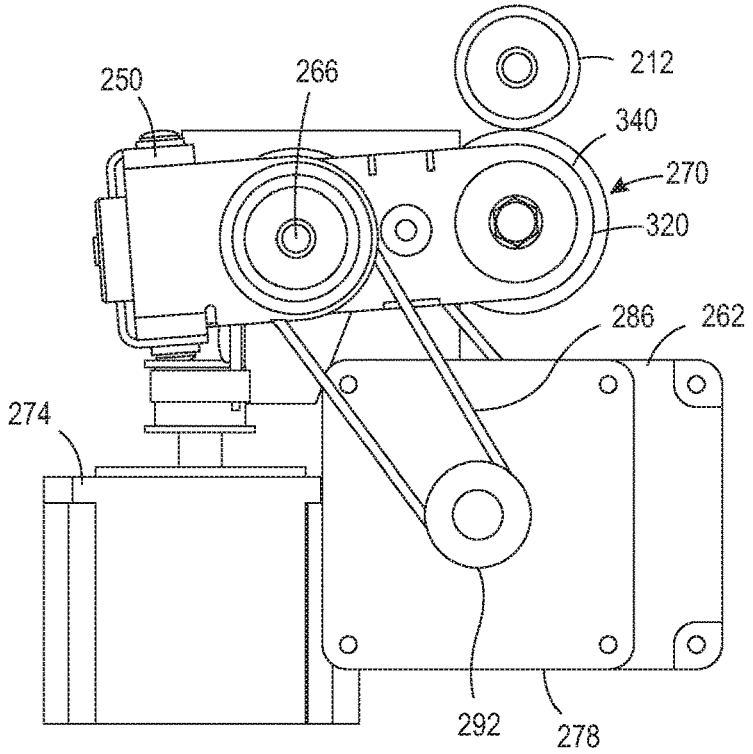
FIG. 4B is a side view of a lower nip assembly of FIG. 2A in which the wheel of the nip wheel driver is engaged to the fixed roller to form a nip for substrate de-skewing and lateral registration.

FIG. 4A depicts the lower nip O-ring 340 of the wheel 320 disengaged from the upper fixed roller 212. To form the nip, the controller 214 operates the actuator 278 to rotate the pulley 292 in the counterclockwise direction to rotate the endless belt 286 in the same direction. This rotation pivots the actuator bar 250 about the rotating member 266 in the counterclockwise direction to swing the rotating wheel 320 and the O-ring 340 fitted in the groove of the wheel 320 up into engagement with the fixed roller 212, which is the position depicted in FIG. 4B. From the position shown in FIG. 4B, the controller 214 operates the actuator 278 to rotate the pulley 292 clockwise to reverse the movement of the actuator bar 250 and return the O-ring 340 on the wheel 320 to the position shown in FIG. 4A.

In operation, at least a pair of the single nip de-skew, lateral registration, and process direction registration devices are installed along a portion of a media transport path in a printer prior the media transport path entering a print zone in the printer. The single nip de-skew and lateral registration devices are aligned in a process direction so the wheels 270 of the devices 204 are centrally positioned in the cross-process direction of the media transport path. The devices are separated in the process direction by a distance that corresponds to a length of substrate to be printed by the printer. If the printer is to accommodate a variety of substrate lengths, then a plurality of devices 204 are installed in the printer and separated from one another by a distance in the process direction so two of the devices are positioned to manipulate the trailing edge and the leading edge of the substrates for a particular length. Also, as the media is transported through the system of devices 204, the two devices that are separated by the greatest distance and yet still contact the media can continue to manipulate the media as needed to achieve the desired position of the media. Likewise, as the next sheet of media enters the system, progressively further apart devices 204 are engaged to maximize the spacing between the devices 204, while only two devices 204 at a time contact any sheet of media.

As substrates of a predetermined length are transported along the media transport path, the controller 214 receives signals from the CCD sensors 212 to identify the position of an edge of each substrate that extends in the process direction and to identify an amount of skew in the substrate. The controller 214 also receives the signals generated by the photoelectric sensors to detect the positions of the leading edges and the trailing edges of each substrate as they progress along the media transport path so the controller can activate the actuator 262 of the appropriate de-skew and registration devices 204 at the appropriate time to rotate the nip wheel drivers 254 to form nips between the wheels 270 and the fixedly mounted rollers 212 as the leading edges approach one device 204 and as the trailing edges approach the other device 204. The controller 214 then operates the actuators 274 and 278 selectively to regulate the speed of rotation for the wheels 270 in the appropriate devices 204 to register the substrates in the process direction and to translate the nip wheel drivers 254 of the same devices along a portion of the length of the fixedly mounted rollers 212 to laterally register and de-skew the substrates. As the leading edges and the trailing edges of the substrates leave the nips, the controller 214 operates the actuator 262 to disengage the wheel 270 from the fixedly mounted roller 212 until the next pair of leading and trailing edges approach the wheels 270 of the devices 204.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A single nip de-skew, lateral registration, and process direction registration device for a printer comprising:

a first roller configured to be fixedly mounted in the printer at a position on one side of a media transport path in the printer, the first roller having a length in a cross-process direction sufficient to extend a portion of the first roller over a plurality of centerlines for a plurality of media widths; and a nip assembly that is configured to be positioned on an opposite side of the media transport path, the nip assembly including:

a first member having a longitudinal axis that extends across the media transport path in the cross-process direction;

a wheel that is operatively connected to the first member at a position halfway between a first end and a second end of the first member; and a first actuator operatively connected to the first member, the first actuator being configured to rotate the first member about a longitudinal axis of the first member to rotate the wheel of the nip assembly.

2. The single nip de-skew, lateral registration, and process direction registration of claim 1, the nip assembly further comprising:

a second member having a longitudinal axis that is parallel to the longitudinal axis of the first member, the second member being operatively connected to the wheel; and a second actuator operatively connected to the second member, the second actuator being configured to pivot the second member about the first member bidirectionally to move the wheel between a first position where the wheel forms the nip with the first roller and a second position where the wheel disengages from the first roller.

3. The single nip de-skew, lateral registration, and process direction registration device of claim 2 wherein the first roller has a length in the cross-process direction that is longer than a length of the wheel of the nip assembly.

4. The single nip de-skew, lateral registration, and process direction registration device of claim 3 further comprising:

a first endless belt operatively connected to the second actuator so the second actuator rotates the first endless belt in one direction to move the wheel to the first position where the wheel forms the nip with the first roller and moves the first endless belt in a direction opposite to the first direction to move the wheel to the second position where the wheel disengages from the first roller.

5. The single nip de-skew, lateral registration, and process direction registration device of claim 4 further comprising:

a second endless belt that extends in the cross-process direction;

a pair of pulleys about which the second endless belt is mounted;

a third actuator operatively connected to one of the pulleys in the pair of pulleys, the third actuator being configured to rotate the pulley to which it is operatively connected and the second endless belt bidirectionally; and a first connector that operatively connects the wheel to the second endless belt to move the wheel bidirectionally in the cross-process direction along the length of the first roller.

6. The single nip de-skew, lateral registration, and process direction registration device of claim 5 further comprising:

a bracket having four openings, a first pair of openings being aligned with one another on opposite legs of the bracket and a second pair of openings being aligned with one another on opposite legs of the bracket;

four bearings, one bearing being mounted in each of the four openings and the first member extending through the bearings in the first pair of openings in the bracket;

a pulley fixedly mounted about the first member within the bracket;

the first connector being mounted about the first member within the bracket; and a third endless belt operatively connecting the pulley to the wheel.

7. The single nip de-skew, lateral registration, and process direction registration device of claim 6 further comprising:

a third member extending between the bearings in the second pair of openings;

a pulley fixedly mounted about the third member and the third endless belt connecting the pulley fixedly mounted about the first member to the pulley fixedly mounted about the third member; and the wheel is fixedly mounted about the third member.

8. The single nip de-skew, lateral registration, and process direction registration device of claim 7 further comprising:

an O-ring mounted about the wheel.

9. The single nip de-skew, lateral registration, and process direction registration device of claim 8 wherein the O-ring has a coefficient of friction that is greater than a coefficient of friction of the first roller.

10. The single nip de-skew, lateral registration, and process direction registration device of claim 9 further comprising:

a second connector configured to connect the bracket to the second member.

11. The single nip de-skew, lateral registration, and process direction registration device of claim 10, the second connector further comprising:

a bearing mounted about a shaft that extends from the bracket; and the second member is configured to engage the bearing mounted about the shaft that extends from the bracket on opposite sides of the bearing.

12. A single nip de-skew, lateral registration, and process direction registration device for a printer comprising:

a first roller configured to be fixedly mounted in the printer at a position on one side of a media transport path in the printer, the first roller having a length in a cross-process direction sufficient to extend a portion of the first roller over a plurality of centerlines for a plurality of media widths; and a nip assembly that is configured to be positioned on an opposite side of the media transport path, the nip assembly including:

a first member having a longitudinal axis that extends across the media transport path in the cross-process direction;

a wheel that is operatively connected to the first member at a position halfway between a first end and a second end of the first member;

a first actuator operatively connected to the first member, the first actuator being configured to rotate the first member about a longitudinal axis of the first member to rotate the wheel of the nip assembly;

a second member having a longitudinal axis that is parallel to the longitudinal axis of the first member, the second member being operatively connected to the wheel; and a second actuator operatively connected to the second member, the second actuator being configured to pivot the second member about the first member bidirectionally to move the wheel between a first position where the wheel forms the nip with the first roller and a second position where the wheel disengages from the first roller.

13. The single nip de-skew, lateral registration, and process direction registration device of claim 12 wherein the first roller has a length in the cross-process direction that is longer than a length of the wheel of the nip assembly.

14. The single nip de-skew, lateral registration, and process direction registration device of claim 13 further comprising:

a first endless belt that extends in the cross-process direction;

a pair of pulleys about which the first endless belt is mounted;

a third actuator operatively connected to one of the pulleys in the pair of pulleys, the third actuator being configured to rotate the pulley to which it is operatively connected and the first endless belt bidirectionally; and a first connector that operatively connects the wheel to the first endless belt to move the wheel bidirectionally in the cross-process direction along the length of the first roller.

15. The single nip de-skew, lateral registration, and process direction registration device of claim 14 further comprising:

a second endless belt operatively connected to the second actuator so the second actuator rotates the second endless belt in one direction to move the wheel to the first position where the wheel forms the nip with the first roller and moves the second endless belt in a direction opposite to the first direction to move the wheel to the second position where the wheel disengages from the first roller.

16. The single nip de-skew, lateral registration, and process direction registration device of claim 15 further comprising:

a bracket having four openings, a first pair of openings being aligned with one another on opposite legs of the bracket and a second pair of openings being aligned with one another on opposite legs of the bracket;

four bearings, one bearing being mounted in each of the four openings and the first member extending through the bearings in the first pair of openings in the bracket;

a pulley fixedly mounted about the first member within the bracket;

the first connector being mounted about the first member within the bracket; and a third endless belt operatively connecting the pulley to the wheel.

17. The single nip de-skew, lateral registration, and process direction registration device of claim 16 further comprising:

a third member extending between the bearings in the second pair of openings;

a pulley fixedly mounted about the third member and the third endless belt connecting the pulley fixedly mounted about the first member to the pulley fixedly mounted about the third member; and the wheel is fixedly mounted about the third member.

18. The single nip de-skew, lateral registration, and process direction registration device of claim 17 further comprising:

an O-ring mounted about the wheel.

19. The single nip de-skew, lateral registration, and process direction registration device of claim 18 wherein the O-ring has a coefficient of friction that is greater than a coefficient of friction of the first roller.

20. The single nip de-skew, lateral registration, and process direction registration device of claim 19 further comprising:

a bearing mounted about a shaft that extends from the bracket; and the second member is configured to engage the bearing mounted about the shaft that extends from the bracket on opposite sides of the bearing.

* * * * *